US005775036A

United States Patent [19]

Stanley, Sr.

[11] Patent Number: 5,775,036

[45] Date of Patent: Jul. 7, 1998

[54] ALIGNMENT OF OBJECTS

[76] Inventor: Jesse M. Stanley, Sr., 154 Pattrell Rd., Norwich, Vt. 05055

[21] Appl. No.: 632,289

[22] Filed: Apr. 15, 1996

[51] Int. Cl.[6] ..... E04G 21/26; E04G 25/06

[52] U.S. Cl. ..... 52/127.2; 52/745.16; 52/749.1; 248/354.4

[58] Field of Search ..... 52/127.2, 217, 52/749.1, 204.1, 745.16, 745.15, 204.56; 248/351, 354.3, 354.4; 33/194, 645, 404, 667; 269/905, 50, 904; 108/54.1, 143

[56] References Cited

U.S. PATENT DOCUMENTS

| | | | |
|---|---|---|---|
| 325,985 | 9/1885 | Smyth | 108/143 |
| 1,946,961 | 2/1934 | Blade | 33/194 |
| 3,107,635 | 10/1963 | Kaiser | 108/54.1 |
| 3,168,305 | 2/1965 | Lee | 33/194 |
| 3,327,983 | 6/1967 | Snapp | 248/354.4 |
| 3,329,103 | 7/1967 | Cohen | 108/54.1 |
| 3,851,868 | 12/1974 | Lagasse | 33/194 X |
| 4,048,771 | 9/1977 | Thistlethwaite | 52/127.2 |
| 5,340,095 | 8/1994 | Eicher, III | 269/905 X |
| 5,377,462 | 1/1995 | Beals et al. | 52/127.2 |

FOREIGN PATENT DOCUMENTS

| | | | |
|---|---|---|---|
| 2841480 | 4/1980 | Germany | 52/217 |

*Primary Examiner*—Michael Safavi
*Attorney, Agent, or Firm*—George E. Kersey

[57] ABSTRACT

An apparatus allows for the alignment of objects with respect to one another. With a base element having an upper extendable member positioned upon and movable relative to the base. Recesses are provided on either end of the base and extendable member which allow for the apparatus to hold objects in alignment with respect to one another. The apparatus may be used to align door jambs and window frames when installing portals within a wall structure. Fasteners may be loosened to allow for relative movement between the base and extendable member. When the proper length is attained the fasteners are tightened allowing the apparatus to hold the aligned objects until the objects are set in place within the final construction.

17 Claims, 3 Drawing Sheets

FIG. 3A
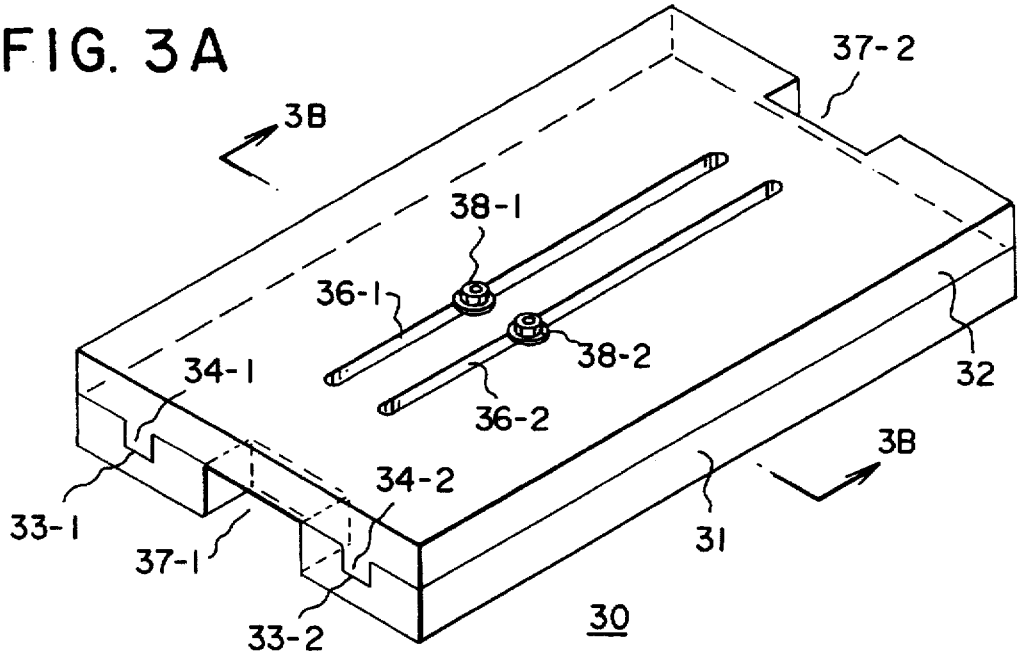
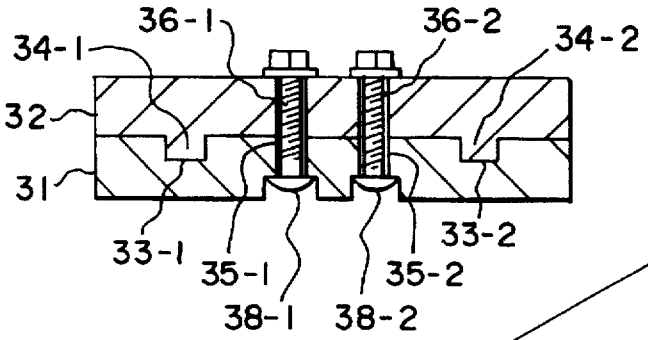
FIG. 3B
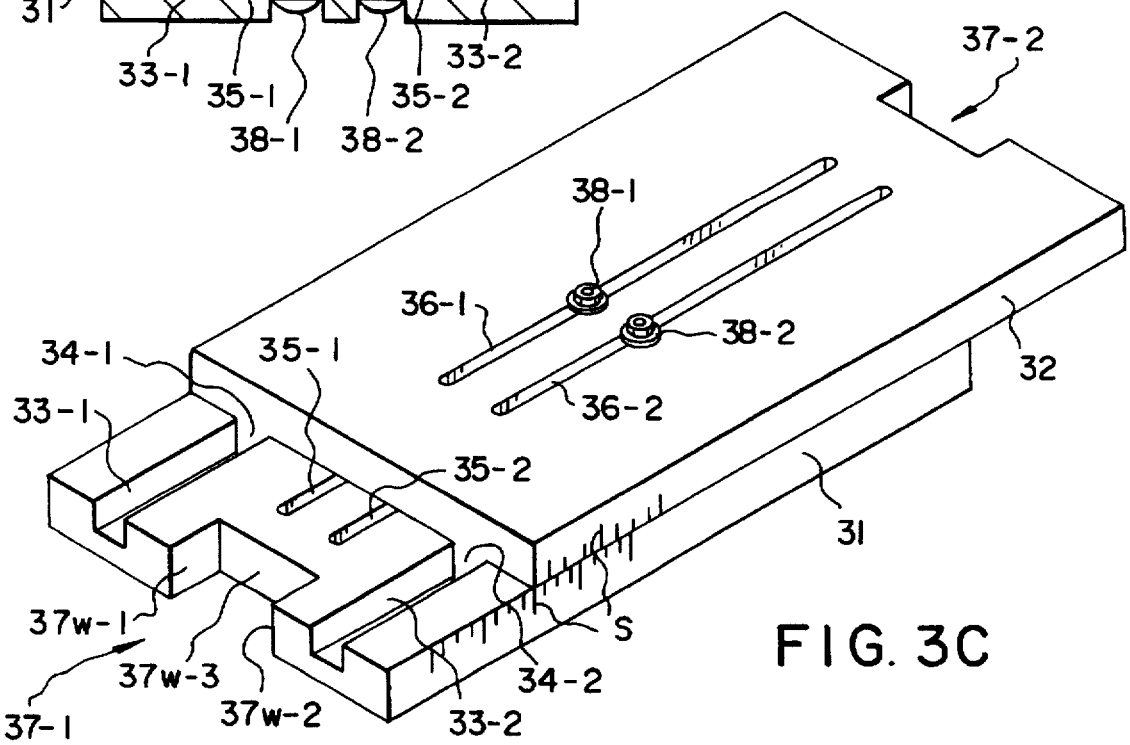
FIG. 3C

ALIGNMENT OF OBJECTS

This invention relates to the alignment of objects and more particularly to the alignment of door frames for the hanging of doors.

In the hanging or positioning of doors in frames, it is important for the frame to be aligned in a manner that permits the door to fit properly.

In the case of a vertical doorway, for example, if the frame is not correctly aligned, the door will not hang properly. If the opening at the base of a vertical frame exceeds that at the top, the door will be tilted against the floor. Conversely, if the base opening is too narrow, the door will not close properly.

It has been difficult and tedious in the past to make the proper alignment of frames so that associated doors will fit properly.

Accordingly it is an objective of the invention to facilitate the alignment of objects. A related object is to facilitate the alignment of door frames so that associated doors will fit properly.

Another object of the invention is to provide a jig and method for facilitating the alignment of objects, including door frames. A related object is to simplify and shorten the time needed in aligning objects, including door frames.

SUMMARY OF THE INVENTION

In accomplishing the foregoing and related objectives the invention provides for facilitating the alignment of objects by a base with a member positioned thereupon and extendable relative thereto, with means on the base for permitting desired engagement with one of the objects, and complementary engagement means on the member.

The base can be quadrilateral and the member slidable laterally with respect to the base.

In accordance with one aspect of the invention, the base contains a channel for the movement of the member, and the path of the channel can be marked to indicate prescribed positions. The position of the extended member can be fixed relative to the base, and engagement means can be provided by a recess, preferably rectangular, at one end of both the member and the base.

In accordance with another aspect of the invention, the base and member can be used for the alignment of a door frame including a jam wherein the recess is proportioned for spanning said jam. Such a door frame includes oppositely positioned jams and a recess on the base spans one jam and a recess on the member spans the opposite jam.

In a method of the invention for aligning objects the steps include (a) positioning a base against one of the objects; (b) extending a member that is slidable upon the base against another of said objects; (c) fixing the position of the member relative to the base; and (d) moving the combination of the member fixed to the base to another position between the objects.

The method can further include the step of moving the objects at the other position into contact with the combination. Where the objects are opposed verticals of a door frame, the step of positioning a base against one of the objects comprises positioning the base against one of the frame verticals. The step of extending a member that is slidable upon the base against another of said objects comprises extending the member against another of the frame verticals.

The method can also further include the step of fixing the position of the base relative to the member between the frame verticals. The fixed combination of the base and the member can then be moved to another position between the frame verticals, and abutted against the verticals to align the verticals in relation to the positions where the combination has been positioned. The positions of the verticals are fixed relative to one another after their alignment. Where the verticals of the frame are positioned within a wall to provide an opening, the verticals can be shimmed relative to the wall.

In a method of manufacturing apparatus for facilitating the alignment of objects the steps include (a) providing a base and a member associated therewith; (b) forming engagement means on the base and complementary engagement means on the member; and (c) positioning the member to be slidable upon the base. A channel can be provided for the movement of the member relative to the base.

DESCRIPTION OF THE DRAWINGS

Other aspects of the invention will become apparent after considering several illustrative embodiments taken in conjunction with the drawings in which:

FIG. 3A is a perspective view of the alignment jig of FIG. 2;

FIG. 3B is a cross-section of the alignment jig of FIG. 3A taken along the lines 3B—3B in FIG. 3A;

FIG. 3C is a perspective view of the alignment jig of FIG. 3A with its upper member slidably moved along the base in order to position the jig for the alignment of the door frame shown in FIGS. 1A and 2, before the hanging of the door in FIG. 1B.

DETAILED DESCRIPTION

Figure 1A:
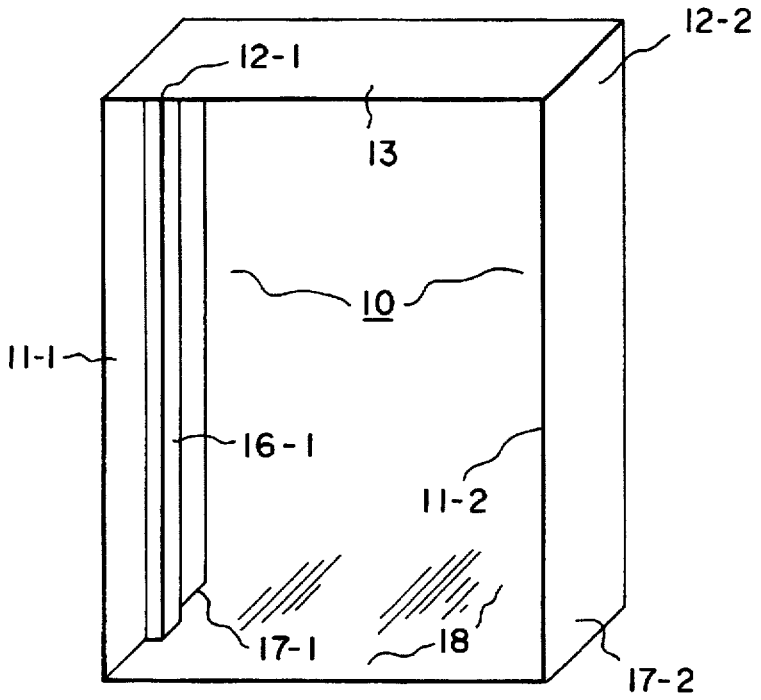
FIG. 1A is a partial perspective view of a door frame that is to be aligned in accordance with the invention.
Figure 1B:
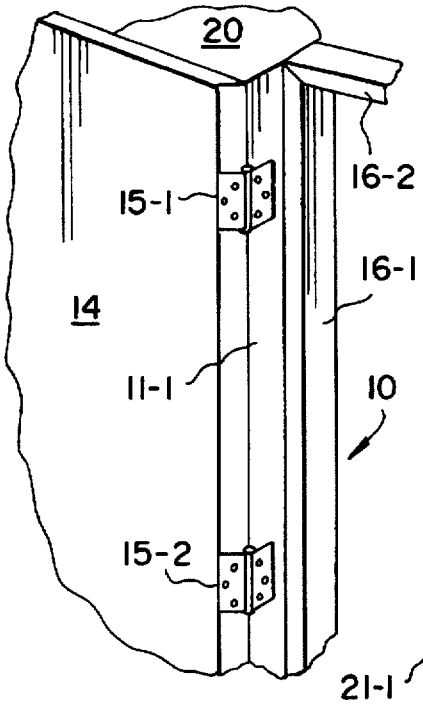
FIG. 1B is a partial perspective view illustrating the attachment of a door within the frame of FIG. 1A.

With reference to the drawings, FIG. 1A shows objects to be aligned in accordance with the invention taking the form of verticals 11-1 and 11-2 for a door frame 10. The verticals 11-1 and 11-2 are joined at their upper ends 12-1 and 12-2 by a top 13. In FIG. 1B a door 14 is to be attached to the frame 10 of FIG. 1A by hinges 15-1 and 15-2 in conventional fashion. The hinges 15-1 and 15-2 are attached to the vertical 11-1 so that the door 14 will close against a door jamb 16-1, a top door jamb 16-2 and side door jamb 16-3 (not shown in FIG. 1B). The jambs 16-1 though 16-2 are used to block the door 14 against further movement after closure. It is apparent that the door 14 will not close properly unless the lower ends 17-1 and 17-2 of the frame 10 have approximately the same separation as the upper ends 12-1 and 12-2. If the lower ends 17-1 and 17-2 are separated farther than the upper ends 12-1 and 12-2, the door 14 will sag downwardly and can even scrape against the floor 18.

Alternatively, if the lower ends 17-1 and 17-2 are closer than the separation of the upper ends 12-1 and 12-2, the door will not seat properly against the upper door jamb 16-2 and against the side door jambs 16-1 and 16-3.

Figure 2:
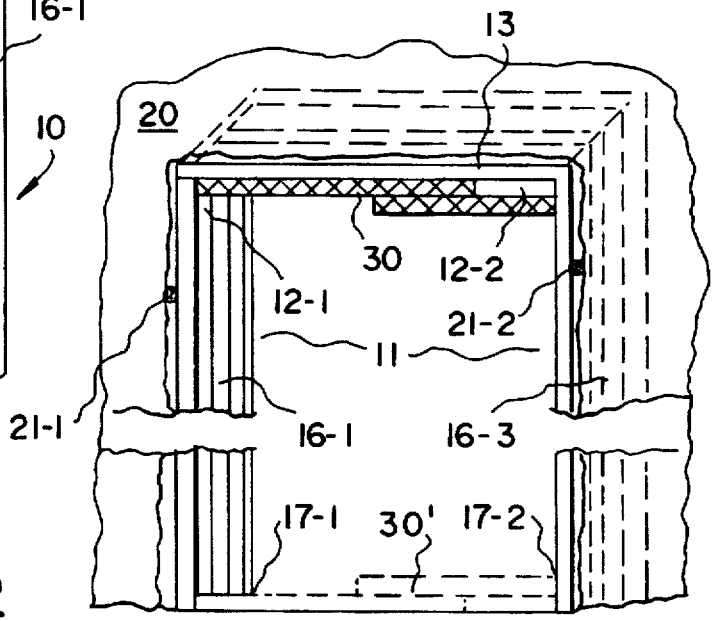
FIG. 2 illustrates the alignment of the frame of FIG. 1A before attachment of the door in FIG. 1B.

In order to properly align the verticals 11-1 and 11-2, it has been common practice to resort to trial and error with often unsatisfactory and time-consuming results. The invention overcomes the prior difficulties in the alignment of door verticals 11-1 and 11-2 by the use of the jig 30 as shown in FIG. 2. The jig 30 maintains mechanically the correct position of the verticals 11-1 and 11-2 during their installation in the wall 20. Initially an opening is left in the wall 20 sufficient to allow placement of the door frame 11 in the opening. The interval between the upper ends 12-1 and 12-2 is fixed by the top 13, but the separation between the lower ends 17-1 and 17-2 is adjustable.

The jig 30 of the invention, as described in detail below, is positioned against the top 13 between the ends 12-1 and 12-2 and adjusted and fixed to the width of the interval between the ends 12-1 and 12-2. The jig 30 is moved to the floor 18 between the lower ends 17-1 and 17-2 to the phantom position 30', and the ends 17-1 and 17-2 are abutted to the jig 30'. This assures that the interval between the upper and lower ends of the verticals 11-1 and 11-2 are identical. The frame 11 is then secured within the wall 20 by shims 21, of which only two shims 21-1 and 21-2 are shown in FIG. 2.

With reference to FIG. 3A and 3C, the alignment jig 30 of the invention, shown in perspective, is formed by a base 31 upon which a member 32 is slidably mounted. The base 31 includes full-length grooves 33-1 and 33-2 which receive projections 34-1 and 34-2 of the upper member 32. The base 31 also includes channels 35-1 and 35-2 positioned under similar channels 36-1 and 36-2 of the upper member 32. The alignment end of the base 31 has a rectangular recess 37-1 to permit proper engagement of the base 31 with the upper end 12-1 of the vertical 11-1 by skirting the hinge jamb 16-1.

A similar and complementary rectangular recess 37-2 is provided at the alignment end of the upper member 32 to permit proper engagement of the member 32 with the upper end 12-2 of the vertical 11-2 by skirting the jamb 16-3. The recesses 37-1 and 37-2 are formed by opposed walls **37*w*-1 and 37*w*-2 separated by a recessed wall 37*w*-3**. It will be appreciated that other recesses may be used, depending upon the nature of the engagement with an object that is desired.

It is to be noted that the jambs 16-1 and 16-3 may have different widths in different door frames. Accordingly the recesses 37-1 and 37-2 of the alignment jig 30 have been selected to be "universal" in being wide enough to accommodate all standard width door jambs. Similarly, although the recesses 37-1 and 37-2 are rectangular, and some jambs are contoured, the depth of the recesses 37-1 and 37-2 have been selected to accommodate all standard door jambs.

FIG. 3B is a cross-section of the alignment jig of FIG. 3A taken along the lines 3B—3B in FIG. 3A showing the fasteners 38-1 and 38-2 by which the position of the base 31 is fixed relative to the upper member 32 when the desired span between objects has been achieved. In FIG. 3B the fasteners 38-1 and 38-2 are conventional bolts, washers and nuts that extend into and out of the channels 35-1 and 36-1 and 35-2 and 36-2. It will be appreciated that the fasteners are illustrative only and that other equivalent forms of fastening may be used.

In the perspective view of FIG. 3C the alignment jig 31 of FIG. 3A is shown with its upper member 32 slidably moved along the base 31 in order to position the jig 31 for the alignment of the door frame 11 shown in FIGS. 1A and 2, before the proper positioning of the door 14 in FIG. 1B.

It will be apparent that a scale can be placed for indicating the degree of separation of the base 31 relative to the upper member 32, such as the scale S on the side wall of the base 31 as seen in FIG. 3C.

While the grooves 33-1 and 33-2, as well as the projections 34-1 and 34-2 in FIGS. 3A through 3C are rectangular in cross-section, other cross sections may be used as well, such as complementary dovetail grooves and projections. However, the rectangular cross sections facilitate pull-apart separation of the base 31 from the upper member 32, as opposed to the sliding separation needed for dovetail grooves. Similarly, the grooves 35-1&2 and 36-1&2 which are elongated oblongs may take other forms as well.

In addition while the base 31 and the member 32 have each two grooves, two channels and two projections, a single groove, single channel and single projection may be employed. In general any convenient arrangement may be employed for obtaining the desired slidable movement of the base 31 in relation to the member 32.

Figure 4:
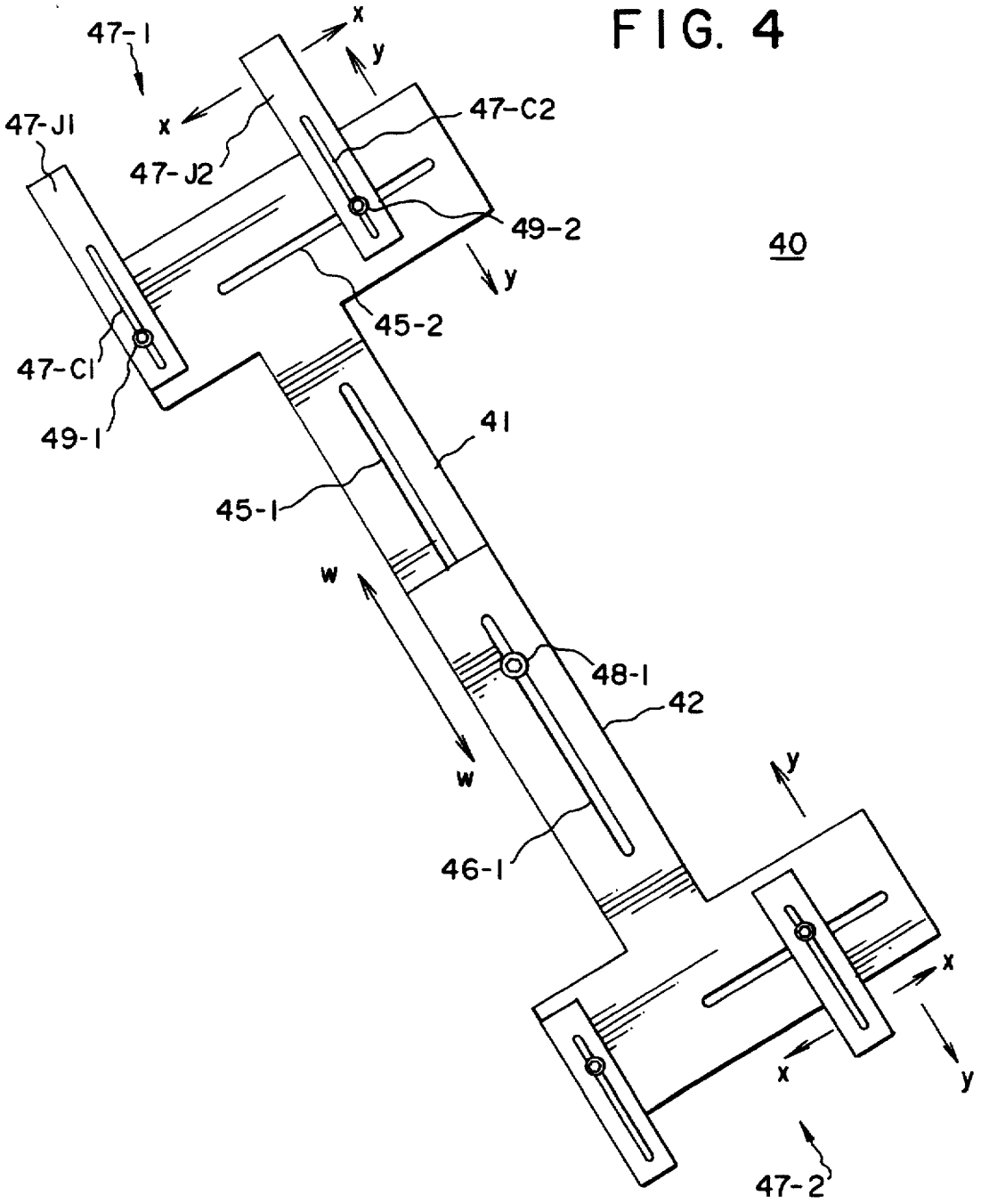
FIG. 4 is a plan view of an alternative jig in accordance with the invention.

Thus as shown in the plan view of FIG. 4, the alignment jig 40 of the invention is formed by a base 41 upon which a member 42 is slidably mounted. The base 41 includes a channel 45-1 positioned under a similar channel 46-1 of the upper member 42. The alignment end of the base 41 has an adjustable rectangular recess 47-1 to permit proper engagement of the base 41 with the upper end of a jamb, such as the jamb 12-1 of the vertical 11-1 in FIGS. 1A and 2, by skirting the hinge-side jamb 16-1. A similar and complementary adjustable rectangular recess 47-2 is provided at the alignment end of the upper member 42 to permit proper engagement of the member 42 with the upper end 12-2 of the vertical 11-2 by skirting the jamb 16-3.

The adjustable recess 47-1 is formed by opposed, slidable wall members **47*j*-1 and 47*j*-2 separated on the head 41-*h* of the base member 41. There is a corresponding configuration for the recess 47-2 of the upper member 42. A depth adjustment of the recess 47-1 is made by moving the wall members 47*j*-1 and 47*j*-2 relative to the head 41-*h* in the direction of the arrows Y—Y along channels 47*c*-1 and 47*c*-2 relative to adjustable fasteners 49-1 and 49-2. In addition, the adjustable wall member 47*j*-2 can be moved laterally along the channel 45-2 of the head 41-*h*** in the direction of the arrows X—X. It will be appreciated that other recesses may be used, depending upon the nature of the engagement with an object that is desired.

It is to be understood further that the foregoing detailed description is illustrative only and that various changes in form, materials and otherwise including the substitution of equivalence can be made with departing from the spirit and scope if the invention as set forth in the appended claims.

What is claimed is:

1. Apparatus for the facilitating the alignment of objects comprising a base;

a member positioned upon and extendable relative to said base;

means on said base for desired momentary engagement with one of said objects; and complementary means on said member for desired momentary engagement with another one of said objects simultaneously with the first mentioned momentary engagement;

wherein said base is quadrilateral with a channel and a fastener extending therein to an underlying channel of said member which is slidable laterally with respect to said base.

2. Apparatus as defined in claim 1 wherein said base contains said channel of equal length to that of said member for the movement of said member.

3. Apparatus as defined in claim 1 wherein the channels coincide and provide a path marked to indicate prescribed positions.

4. Apparatus as defined in claim 1 further including means extending into and out of the channels for fixing the position of said member relative to said base.

5. Apparatus as defined in claim 1 wherein plural channels of said base underlie plural channels of said member and said member is fixed to said base in a position extended relative to said base and fixed thereto.

6. Apparatus as defined in claim 1 wherein said means for permitting desired engagement comprises a recess, narrower than said member and said base, at one end of said member and said base.

7. Apparatus as defined in claim 1 for the alignment of a door frame in combination with a jamb wherein a recess on said base is proportioned for momentarily spanning said jamb.

8. The combination as defined in claim 1 wherein the door frame includes oppositely positioned jambs and a recess on said base momentarily spans one jamb and a recess on said member momentarily spans the opposite jamb.

9. A method of aligning objects comprising the steps of:

extending a member having a channel therein and slidable upon a base having a channel therein to span a prescribed distance at one location between said objects;

fixing the position of said member relative to said base by a fastener which extends into the channels of said base and said member; and moving the combination of the member fixed to said base to another location between said objects.

10. The method of claim 9 further including the step of moving said objects at the other location into contact with said combination.

11. The method of claim 9 wherein said objects are opposed verticals of a door frame and said step of positioning a base against one of said objects comprises momentarily positioning said base against one of said verticals.

12. The method of claim 11 wherein the step of extending a member that is slidable upon said base against another of said objects comprises extending said member momentarily against another of said verticals.

13. The method of claim 12 further including the step of momentarily fixing the position of said base relative to said member between said verticals.

14. The method of claim 13 further including the step of moving the fixed combination of said base and said member momentarily to another position between said verticals.

15. The method of claim 14 further including the step of momentarily abutting said verticals at said other position against said combination;

thereby to align said verticals in relation to the positions where said combination has been positioned.

16. The method of claim 16 further including the step of fixing the positions of said verticals relative to one another after the momentary alignment thereof.

17. The method of claim 16 wherein said verticals of said frame are positioned within a wall to provide an opening and the momentary fixing of said positions includes the step of shimming said verticals relative to said wall.

* * * * *